US008752708B2

(12) United States Patent
Keefe

(10) Patent No.: US 8,752,708 B2
(45) Date of Patent: Jun. 17, 2014

(54) SHIPPING CARTON CONVERTIBLE TO DISPLAY CONFIGURATION

(75) Inventor: Walter D. Keefe, Carol Stream, IL (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 13/283,743

(22) Filed: Oct. 28, 2011

(65) Prior Publication Data

US 2013/0105355 A1 May 2, 2013

(51) Int. Cl.
*B65D 5/52* (2006.01)

(52) U.S. Cl.
USPC ..... 206/736; 206/738; 206/774; 229/164; 229/240

(58) Field of Classification Search
USPC ..... 206/736, 738, 774, 745–747, 749–750, 206/756–760; 229/164, 200, 210, 237, 229/240–243
See application file for complete search history.

(56) References Cited

U.S. PATENT DOCUMENTS

| | | | | |
|---|---|---|---|---|
| 3,002,613 | A | 10/1961 | Merkel et al. | |
| 3,276,667 | A | 10/1966 | Johnson et al. | |
| 3,447,733 | A | 6/1969 | Smith et al. | |
| 3,531,045 | A | 9/1970 | Johnson | |
| 3,669,251 | A | 6/1972 | Phillips, Jr. | |
| 3,927,761 | A * | 12/1975 | Boyle | 206/756 |
| 4,008,849 | A | 2/1977 | Baber | |
| 4,113,100 | A | 9/1978 | Soja et al. | |
| 4,417,655 | A | 11/1983 | Forbes, Jr. | |
| 4,815,609 | A | 3/1989 | Kiedaisch | |
| 5,048,690 | A * | 9/1991 | Zimmerman | 206/746 |
| 5,098,757 | A | 3/1992 | Steel | |
| 5,582,345 | A | 12/1996 | Lankhuijzen | |
| 6,386,369 | B2 | 5/2002 | Yuhas et al. | |
| 6,478,159 | B1 | 11/2002 | Taylor et al. | |
| 6,510,982 | B2 * | 1/2003 | White et al. | 229/235 |
| 6,729,475 | B2 | 5/2004 | Yuhas et al. | |
| 6,832,683 | B2 | 12/2004 | Boriani et al. | |
| 6,974,033 | B2 | 12/2005 | McLeod et al. | |
| 7,175,066 | B2 | 2/2007 | Varanasi | |
| 7,320,407 | B2 * | 1/2008 | Hubbs et al. | 206/764 |
| 7,628,746 | B2 | 12/2009 | Varanasi | |
| 7,658,318 | B2 | 2/2010 | Walsh et al. | |
| 2003/0146270 | A1 * | 8/2003 | Caille et al. | 229/121 |

(Continued)

FOREIGN PATENT DOCUMENTS

| | | |
|---|---|---|
| DE | 202007015814 | 4/2009 |
| GB | 2464159 | 4/2010 |

*Primary Examiner* — Anthony Stashick
*Assistant Examiner* — Robert Poon
(74) *Attorney, Agent, or Firm* — Matthew M. Eslami

(57) ABSTRACT

A shipping container convertible to a display configuration has a removable cover base removable along perforated lines of weakness to form a display opening. Packages of product in the carton are supported in a horizontal orientation during shipping and in an upright orientation when the removable cover base is removed for display of the products at a point of sale. Roll-over flaps on one wall at the bottom of the display opening capture tuck flaps on opposite side walls, and full overlapping top flaps folded inwardly from opposite side walls close the display opening during shipment. An outer top flap has an end extending over the roll-over flaps, and the end is free of attachment to the roll-over flaps. The top flaps are removed with the removable cover base. In one embodiment a flange extends inwardly over an edge of the display opening to keep packages from falling out.

11 Claims, 7 Drawing Sheets

(56) References Cited

U.S. PATENT DOCUMENTS

| | | | | |
|---|---|---|---|---|
| 2004/0007495 | A1 | 1/2004 | Dye | |
| 2004/0149624 | A1 | 8/2004 | Wischusen et al. | |
| 2005/0000853 | A1 | 1/2005 | Rochefort et al. | |
| 2005/0173269 | A1 | 8/2005 | Lebras | |
| 2006/0006096 | A1* | 1/2006 | Funk | 206/746 |
| 2006/0261140 | A1* | 11/2006 | Holley, Jr. | 229/242 |
| 2010/0000672 | A1 | 1/2010 | Fogle | |
| 2010/0224675 | A1* | 9/2010 | Bell et al. | 229/103 |
| 2010/0276333 | A1* | 11/2010 | Couture | 206/774 |
| 2011/0284621 | A1 | 11/2011 | Couture | |
| 2012/0085817 | A1 | 4/2012 | Gatrost et al. | |

* cited by examiner

SHIPPING CARTON CONVERTIBLE TO DISPLAY CONFIGURATION

FIELD OF THE INVENTION

This invention relates generally to cartons for shipping products to points of sale. More particularly, the invention is a shipping carton that is convertible to a display carton at the point of sale.

BACKGROUND OF THE INVENTION

It is common practice to load a quantity of individual packages of consumer products into corrugated paperboard shipping containers for bulk shipment of the packages to a point of sale. At the point of sale the individual packages are removed from the shipping container and placed on a shelf for display and sale to the consumer.

In many instances, especially in the so-called big box stores, the product packages are left in the shipping container which then also serves to support and display the packages for sale. If the shipping container is a conventional box the retailer must cut away a portion of the box in order to expose the product packages and provide access to them by the consumer. In order to provide a more attractive display and facilitate ease of use by the retailer, combination shipping and display containers have been developed which have sections that may be removed along weakened lines to expose the product packages and provide access to them.

Some conventional shipping and display containers require multiple pieces of corrugated material in their construction and/or are not easily produced on standard box plant converting equipment. Conventional designs also may not provide a container that retains its integrity during shipping and handling, and/or the retailer may be required to use a knife to open the shipping container to convert it to a display configuration. Additionally, removal of a section of conventional shipping and display containers frequently leaves a jagged edge that is unattractive.

Of additional concern with conventional shipping and display containers is their inability to ship bagged, pouched or carded products in a flat or horizontal position and then display them at the point of sale in an upright position.

Accordingly, it would be desirable to have a shipping and display container that uses only a single piece of corrugated material in its construction, that can be easily produced on standard box plant converting equipment, that retains its integrity during shipping and handling, that does not require the use of a knife or other tool to convert it from a shipping to a display configuration, that leaves a clean smooth edge when opened, and that enables the product packages to be loaded into the container and shipped in a horizontal position and displayed in an upright position when the container is opened at the point of sale.

SUMMARY OF THE INVENTION

The present invention provides a shipping carton that is easily convertible to a display configuration at a point of sale. The carton requires only a single piece of corrugated material in its construction and can be produced on standard box plant converting equipment. The carton retains its integrity during shipping and handling and does not require the use of a knife or other tool to convert it from a shipping configuration to a display configuration. In its shipping configuration, the carton has opposite side walls, first and second end walls, and flaps on the top and bottom edges of the side and end walls forming top and bottom walls. At the point of sale the carton is stood on one end and perforated lines of weakness in what is then the top wall, front wall and opposite side walls define a removable cover base or a break-away section that can be removed to form a display opening. Roll-over panels at the bottom edge of the display opening define a clean smooth edge when the carton is opened, and tuck flaps folded inwardly from the side walls are captured between the roll-over panels to help hold the carton in its erected configuration. Product packages can be loaded into the carton and shipped in a horizontal orientation and displayed in an upright orientation when the carton is opened and stood on one end at the point of sale. The end walls will be at the top and bottom of the carton when it is in its display orientation.

The shipping and display container of the invention is made from a single blank of corrugated paperboard cut and scored to define first, second, third and fourth wall panels foldably joined along adjacent side edges and, with reference to the orientation of a carton during filling and shipping, having top and bottom edges. A top flap is foldably joined to the top edge of each of said first, second and third wall panels, and a bottom flap is foldably joined to the bottom edge of each of said first, second, third and fourth wall panels. Roll-over flaps are foldably joined to the top edge of said fourth wall panel, and a glue tab is foldably joined to a side edge of said fourth wall panel. A first tuck flap is foldably joined to an end of said glue tab adjacent said roll-over flaps, and a second tuck flap is foldably joined to the top edge of said third wall panel. A first perforated line of weakness extends across the width of the second wall panel, and second and third frangible perforated lines extend diagonally across the corners of the first and third wall panels on opposite sides of the second wall panel.

The blank may be cut, scored and folded on standard box plant converting equipment. The manufacturer of the shipping and display container folds the blank about a fold line between its ends and adhesively attaches a glue tab on one end of the blank to the opposite end of the blank to form a flattened tubular construction that is shipped to a customer who erects the flattened construction into a finished carton and fills it with packages of product for shipment to a point of sale. The top flaps are first folded into operative position, with the roll-over flaps capturing the tuck flaps on opposed side walls to help hold the carton in its erected configuration. The roll-over flaps define the bottom edge of a display window when the carton is in its display configuration. The top flaps are full overlapping flaps, including a full top flap that overlies and protects the display window during shipment. The full flaps allow for all top flap edges to be in the same plane, which is critical for proper case squaring when die-cutting, folding and gluing the carton on standard box plant converting equipment. The top flaps include major flaps on opposed side walls, and these major flaps are attached to one another in the erected carton. Alternatively, rather than attaching the major flaps to one another, tape may be applied to hold the top flaps in operative position. Tape closure does not interfere with the panel removal process and no knife is needed to open the case. Covering of the display window by the outside major flap avoids unsightly perforation tearing found on most traditional display windows.

After the top flaps have been secured in operative position by the customer, the carton is inverted so that its open bottom side is up. Packages of product are then loaded into the carton through the open bottom and the bottom flaps are folded and secured in closed position by the use of adhesive or tape or other suitable securing means. The filled carton may then be shipped with the product packages disposed in horizontal position. At the point of sale, the carton is stood on one end so that the product packages are oriented in an upright position and a portion of what then constitutes the front, top and side walls in the thus oriented carton is removed along the perforated lines of weakness to form a display opening or window in the front, top and side walls, with the product packages oriented in a forwardly facing upright position.

This invention is unique in that the corrugated paperboard carton can be die-cut, folded and glued on standard box plant equipment and is designed to provide a display option having the following attributes: (1) A one-piece structure with a unique design feature of the top flaps that allows for a display opening or window to be formed and covered by an outside major flap for both protection and ease of removing the outside panel, resulting in a clean attractive ease display. (2) Forming one of the tuck flaps as an extension of the glue tab and not gluing the extension so that the tab may be used to form a part of the front display window, permitting the outside full flap to be fully intact. Normally, the material to create the side tuck flap captured by the roll-over flaps would come from the outside major flap. This also allows the use of tape to close the carton. (3) The carton is shipped upright, with the top and bottom flaps oriented top and bottom so that the product packages in the carton are supported and shipped in a horizontal position, and the carton is then flipped onto its end for display, with the product packages oriented upright. This allows product that must be shipped flat to be displayed upright at the point of sale. (4) The positioning of the perforations and added score lines in the side and top panels (display mode) allows for quick and easy removal for displaying the product. The outside flap that covers the display window allows for a clean attractive window with no perforations present in the edges of the window.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
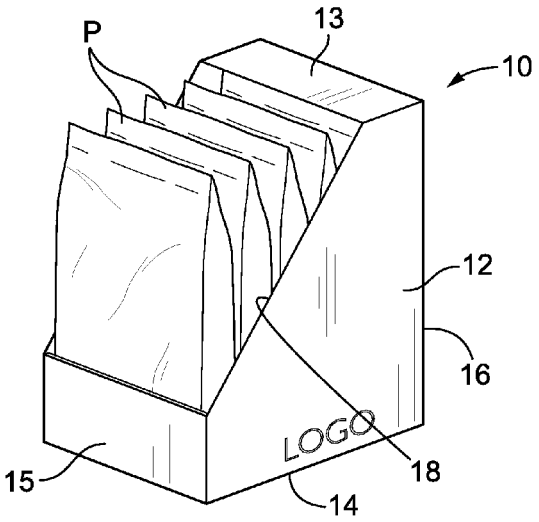
FIG. 1 is a front top isometric view of a shipping and display carton according to the invention, shown in its display configuration.
Figure 2:
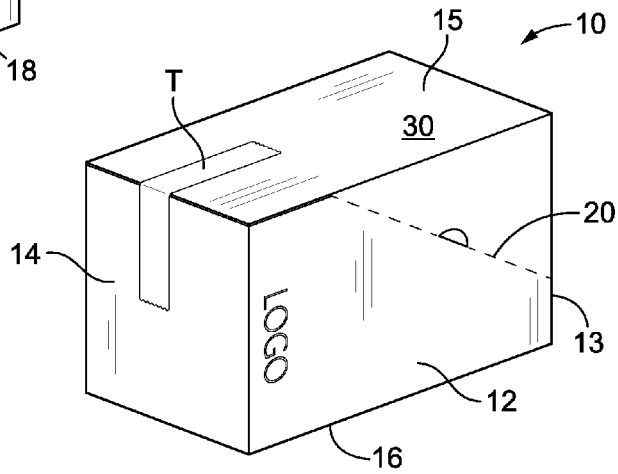
FIG. 2 is an isometric view of the carton of the invention shown in its shipping configuration.
Figure 3:
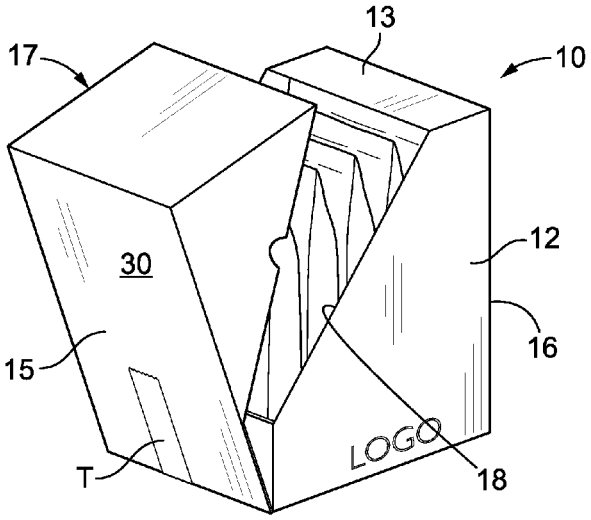
FIG. 3 is an isometric view showing the carton of the invention in the process of being opened.

Referring more specifically to the drawings, a carton according to a first embodiment of the invention is indicated generally at 10 in FIGS. 1-11. With reference to the orientation of the carton during filling and shipping, shown in FIGS. 2 and 10, the carton comprises a parallelepiped having opposite side walls 11 and 12, end walls 13 and 14, and top and bottom walls 15 and 16. At the point of sale, the carton is oriented in its display configuration by flipping it onto its end 14 as shown in FIG. 1 and removing a removable cover base or removable section 17 of the carton to form a display opening or window 18 extending over a portion of what now constitutes a display base having the front wall, top wall and opposite side walls to expose the upright product packages P in the carton. The removable cover base 17 is separated from the display base along perforated lines of weakness 19 and 20 extending diagonally in the side walls, and a perforated line of weakness 21 extending across the width of the wall 13.

Figure 4:
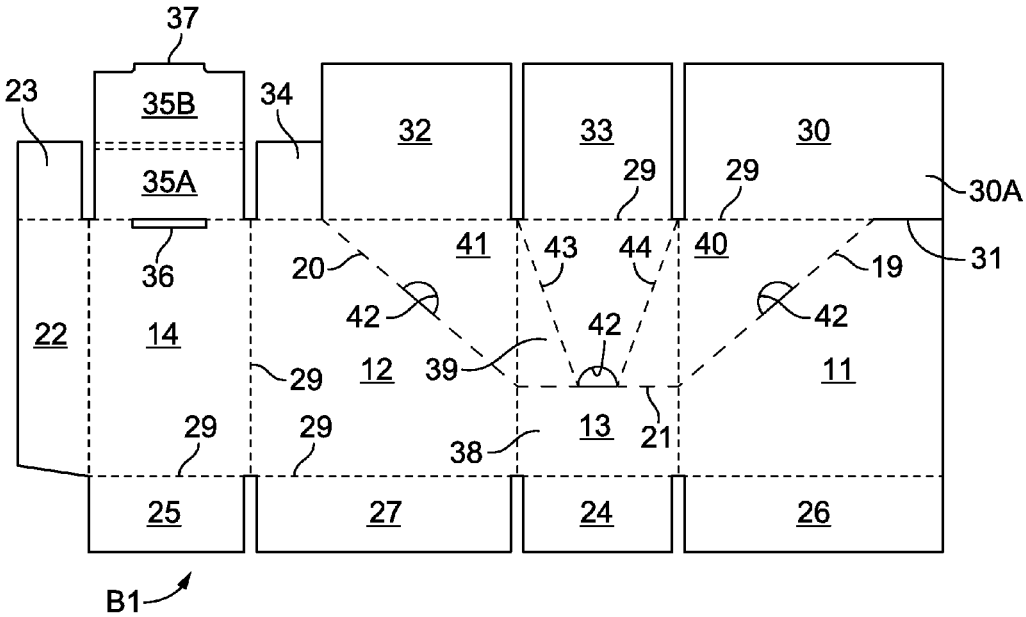
FIG. 4 is a plan view of the blank used in making the carton of the invention.
Figure 5:
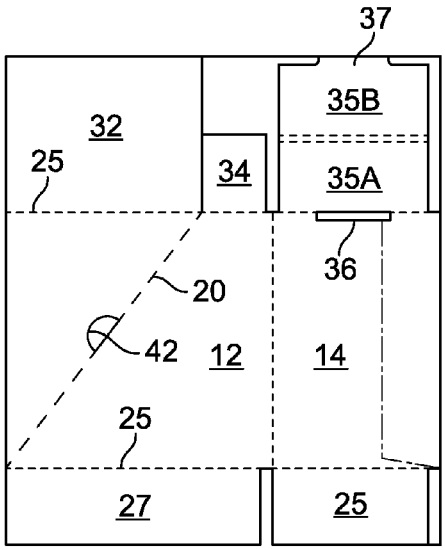
FIG. 5 is a plan view of the folded and glued blank in the flattened configuration for shipment to a customer who erects the carton, fills it with product and ships it to a point of sale.

A blank B1 for making the carton 10 is shown in FIG. 4. A series of fold scores 29 in the blank define a first side wall panel 11 at a first end of the blank, a first end wall panel 13 adjoining the first side wall panel 11, a second side wall panel 12 adjoining the first end wall panel along an edge opposite that edge joined to the first side wall panel, and a second end wall panel 14 adjoining the second side wall panel along the edge opposite the first end wall panel. A glue tab 22 is foldably joined to the edge of the second end wall panel 14 opposite the edge joined to the second side wall panel, and a first tuck flap 23 extends from one end of the glue tab.

Minor bottom flaps 24 and 25 are foldably joined to bottom edges of the end wall panels 13 and 14, respectively, and major bottom flaps 26 and 27 are foldably joined to bottom edges of the side wall panels 11 and 12, respectively.

A first major top flap 30 is foldably joined to the first side wall panel 11 along the edge opposite the edge to which the major bottom flap 26 is attached. One end 30A of the flap 30 is separated from the side wall panel 11 by a cut 31, defining an extended end for a purpose described hereinafter. A smaller major top flap 32 is foldably joined to the second side wall panel 12 along the edge opposite the edge to which the major bottom flap 27 is attached, and a minor top flap 33 is foldably joined to the end wall panel 13 opposite the edge to which the minor bottom flap 24 is attached. A second tuck flap 34 is foldably joined to the side wall panel 12 adjacent the flap 32, and roll-over flaps 35A and 35B are foldably joined to the end wall panel 14 opposite the edge to which the minor bottom flap 25 is attached. A slot 36 is formed in the end wall panel 14 adjacent its folded connection with the roll-over flaps, and a locking tab 37 projects from the free edge of roll-over panel 35B.

The line of perforations 21 extends across the width of the wall panel 13 spaced approximately ⅓ the length of the panel from the edge to which the bottom flap 24 is attached, defining first and second rectangular panels 38 and 39. The line of perforations 19 extends diagonally across first side wall panel 11 from one end of the line 21 to the inner end of cut 31, defining a triangular corner panel 40, and the line of perforations 20 extends diagonally across second side wall panel 12 from the opposite end of the line 21 to the juncture between top flap 32 and tuck flap 34, defining a triangular corner panel 41. Semi-circular cut-outs 42 are formed in the panels 39, 40 and 41 contiguous to the respective lines of perforations and midway their length. The cut-outs 42 define finger access openings to enable a user's finger to be inserted for pulling out on the panels to separate the removable section along the lines of perforation. Crushed lines 43 and 44 extend diagonally across panel 13 from opposite sides of the cut-out 42 to the forward corners of the panel to focus energy and initiate tearing of the perforated line 21 outwardly from the cut-out to the sides of the panel 13, where tearing propagates along perforated lines 19 and 20.

Figure 6:
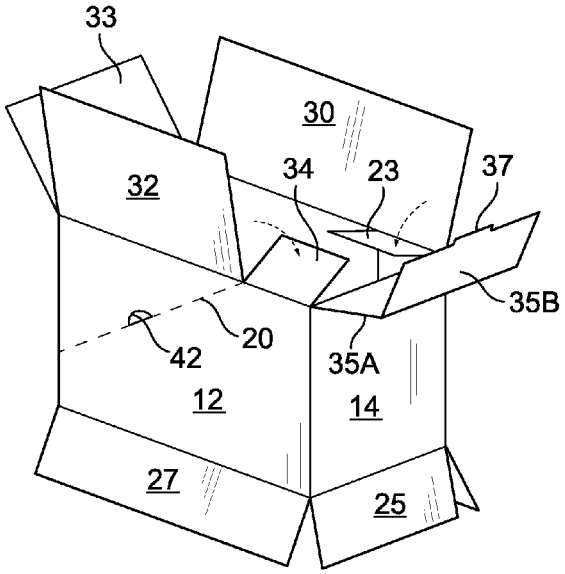
FIG. 6 is a top isometric view of the carton opened into a tubular configuration and showing the tuck flaps being folded into operative position.
Figure 7:
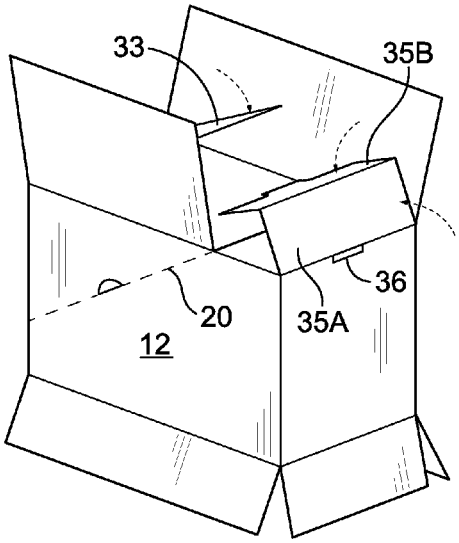
FIG. 7 is a top isometric view showing the roll-over flaps being folded into operative position to capture the tuck flaps.
Figure 8:
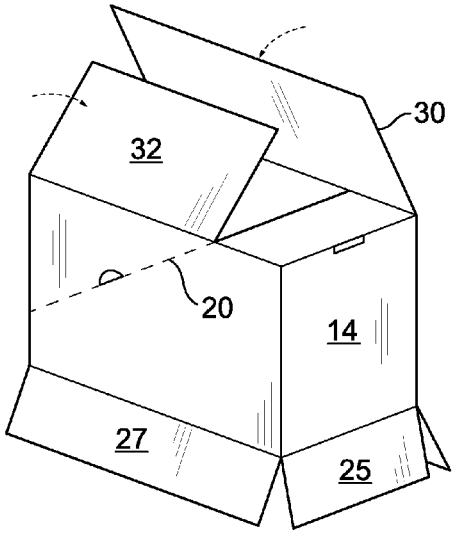
FIG. 8 is a top isometric view showing the major bottom flaps being folded into operative position.

The steps for erecting the carton are depicted in FIGS. 6-11. In FIG. 6 the carton is shown opened up into a tubular configuration and oriented with the top flaps up and the bottom flaps down. As seen in FIGS. 6-8, the tuck flaps 23 and 34 are first folded inwardly, and the roll-over flaps 35A and 35B are then folded inwardly over the tuck flaps, capturing the tuck flaps between them, with the locking tab 37 on the edge of roll-over panel 35B inserted into the slot 36 to hold the roll-over flaps in position. Minor top flap 33 is folded inwardly, followed by folding of the smaller major top flap 32, and then major top flap 30. The two major top flaps 30 and 32 may be secured together in any suitable way, as by use of adhesive or other suitable fastener, but in the preferred embodiment a strip of tape T is applied over the outer flap 30 and downwardly over panel 14, which will be on the bottom when the carton is in its display configuration. It will be noted that prior to converting the carton to its display configuration there are two full overlapping flaps 30 and 32 extending over the area that will become the display opening, with the extended end 30A of the outside major flap 30 extending over the roll-over flaps, affording protection during shipment. This extended end is not attached to the underlying roll-over flaps and is carried away with the break-away section when it is removed as described below.

Figure 9:
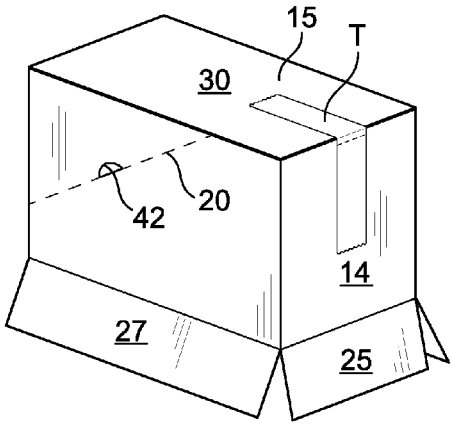
FIG. 9 is a top isometric view showing tape applied to hold the top flaps in their operative position.
Figure 10:
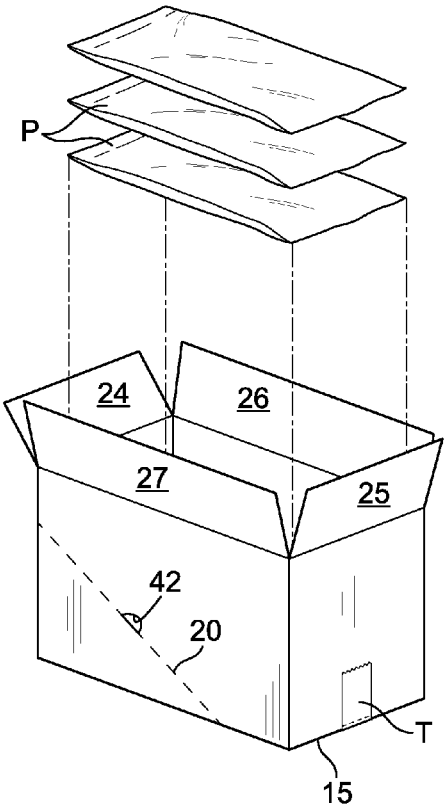
FIG. 10 is an isometric view showing the carton inverted with its open bottom side up and product packages being loaded into the carton so that the packages are disposed horizontally.
Figure 11:
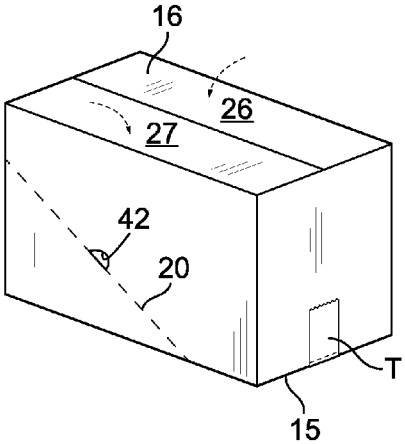
FIG. 11 is an isometric view of the completed carton ready to be shipped, with the bottom flaps held closed by the use of tape.
Figure 12:
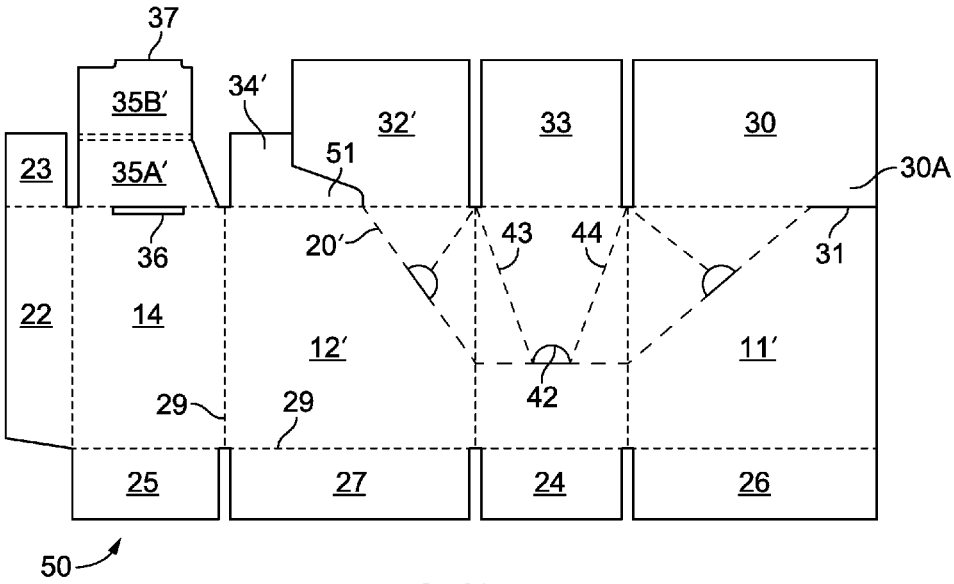
FIG. 12 is a plan view of the blank for making a modified carton according to the invention.
Figure 13:
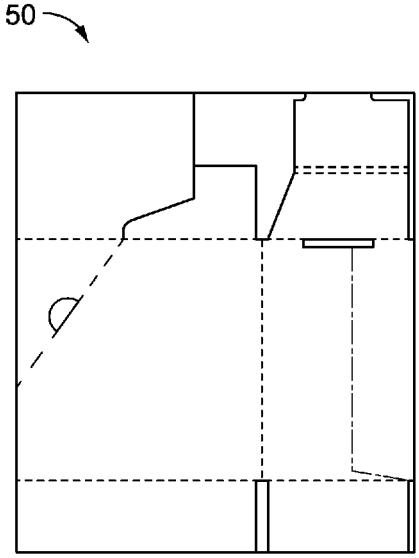
FIG. 13 is a plan view of the folded and glued blank in the flattened configuration of the carton of FIG. 12.
Figure 14:
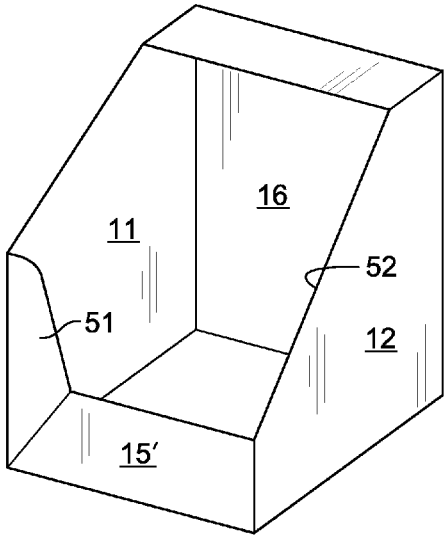
FIG. 14 is a top front isometric view of a modified carton according to the invention, shown in its display configuration but devoid of product packages, wherein a product retaining flange is provided at one edge of the display opening to help retain product packages in the carton
Figure 15:
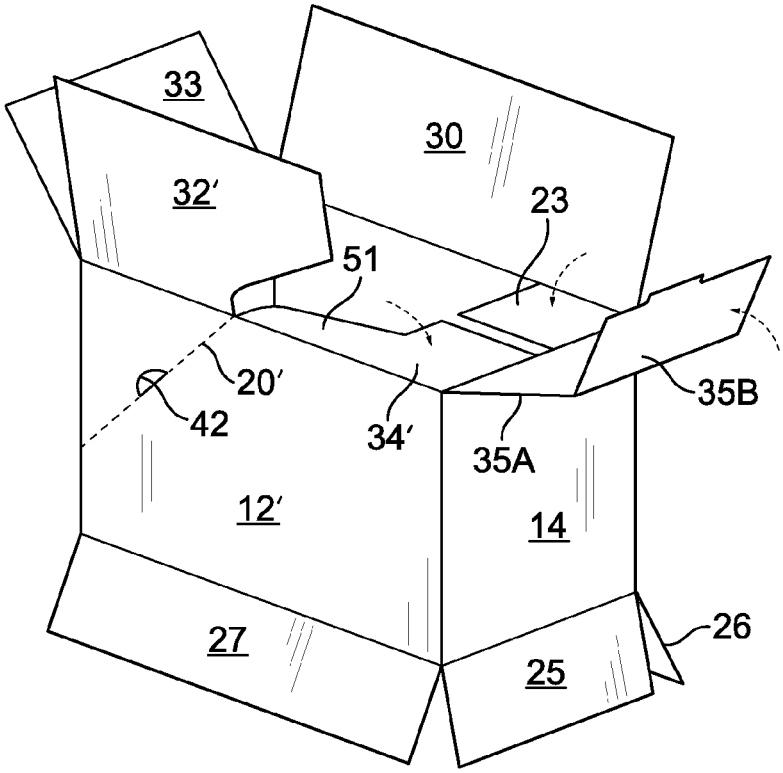
FIG. 15 is a top isometric view of the carton of FIG. 12, showing the tuck flaps being folded inwardly into operative position.

As shown in FIGS. 9-11, after the top flaps have been folded and secured, the carton is inverted so that the open bottom is oriented up, and packages of product P are loaded into the container through the open bottom. The minor bottom flaps 24 and 25 are then folded inwardly, followed by folding of the major bottom flaps 26 and 27. The bottom flaps may be secured in their operative folded positions in any suitable way, as by use of adhesive, tape, or other fastener.

The loaded and closed carton is then shipped in the orientation shown in FIG. 11, or inverted with the opposite side up, so that the packages of product are in a horizontal position during shipment.

At the point of sale, the merchant inserts a finger into at least the opening 42 in the wall 13 and pulls outwardly to break the lines of perforation 19, 20 and 21. This enables the removable cover base 17 of the carton to be removed in one piece, including all of the top wall 15 except for the roll-over flaps and tuck flaps (now the forward wall in the display orientation), and a forward portion of wall 13 (now the top wall) and opposite side walls. If necessary or desired, a finger may also be inserted into one or both the openings 42 in the side walls to facilitate removal of the removable cover base.

An alternate embodiment of the invention is indicated generally at 50 in FIGS. 12-18. This form of the invention is substantially identical to the form described above, except that a retaining flange 51 extends inwardly from one side of the display opening 52 to prevent product packages P from falling out of the container when it is in its display configuration. Corresponding parts are indicated by like reference numerals primed.

Figure 16:
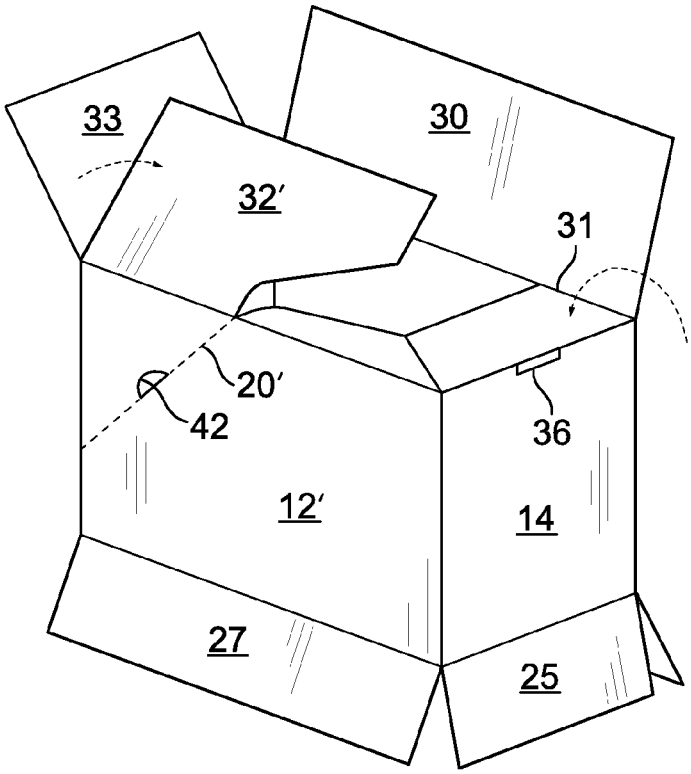
FIG. 16 is a top isometric view of the carton of FIG. 12, showing the roll-over flaps folded into operative position and showing the smaller of the two major flaps being folded inwardly.
Figure 17:
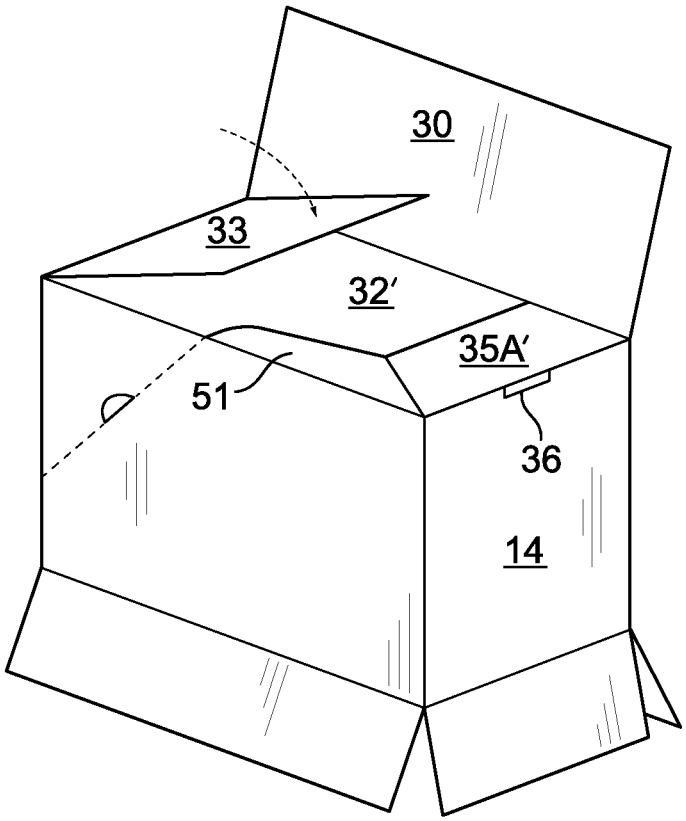
FIG. 17 is a top isometric view of the carton of FIG. 12, with the smaller of the major flaps in operative folded position and showing the minor flap opposite the roll-over flaps being folded.
Figure 18:
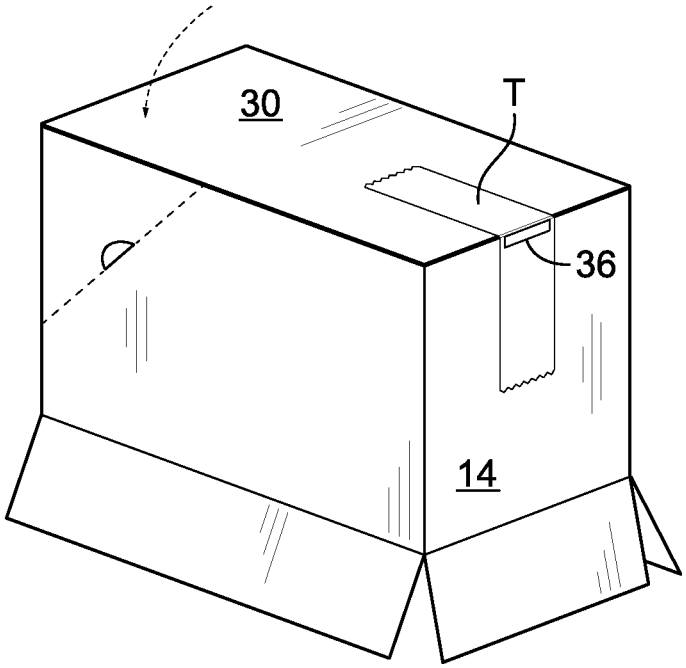
FIG. 18 is a top isometric view of the carton of FIG. 12, showing the top flaps fully folded into their operative position and with tape applied to hold them closed.

The retaining flange 51 extends from one side of tuck flap 34' and is formed by making a shaped cut into the adjacent smaller major top flap 32'. To accommodate the retaining flange, the roll-over flaps 35A' and 35B' are cut away on one side, and the perforated line 20' is repositioned so that it terminates at the end of the cut forming the flange 51. In all other respects this form of the invention is the same as the previous form, except that in a preferred sequence of erecting the carton, as shown in FIGS. 16 and 17, the smaller major top flap 32' is folded inwardly before the minor top flap 33' is folded inwardly. If desired, the order of folding flaps 32' and 33' could be reversed.

Accordingly, one aspect of the present invention is directed to a shipping carton convertible into a display configuration at a point of sale which comprises a display base and a removable cover base configured to be attached to the display base to form the shipping carton convertible into a display configuration. The shipping carton convertible into a display configuration comprises opposite side walls each having a length and a top edge and a bottom edge. Opposite end walls each having a width and a top edge and a bottom edge, top flaps are foldably joined to the top edges of the side walls and end walls, and bottom flaps are foldably joined to the bottom edges of the side walls and end walls. A first perforated line of weakness extends across the width of one of the end walls from one side wall to the opposed side wall. Second and third perforated lines of weakness extend from respective opposite ends of the first perforated line and diagonally across respective corners of the side walls to an adjacent top edge of the respective side walls, and with the first perforated line of weakness defining the removable cover base of the carton that when removed forms a display opening devoid of walls extending across a portion of a forward end of the carton above the lines of weakness in the one end wall and the corners of the side walls.

The top flaps include tuck flaps extend inwardly toward one another from the top edges of the opposite side walls at one end thereof. The tuck flaps have a width less than the length of an associated said side wall. Roll-over flaps extend from the top edge of one of the end walls, the roll-over flaps being folded over the tuck flaps to hold the tuck flaps and side walls in folded position and form an edge spaced from the one end wall. Inner and outer major top flaps folded inwardly from the top edges of the opposite side walls into overlapping relationship with one another. The outer of the major top flaps have a free end extend into overlying relationship with the roll-over flaps. The free end is free of attachment to the roll-over flaps.

Another aspect of the present invention is directed to a blank for making a shipping carton convertible into a display configuration at a point of sale which comprises a first side wall panel at a first end of the blank and a first end wall panel adjoining the first side wall panel. A second side wall panel adjoining the first end wall panel along an edge opposite that edge joined to the first side wall panel. A second end wall panel adjoining the second side wall panel along an edge opposite the first end wall panel and a glue tab foldably joined to an edge of the second end wall panel opposite the edge joined to the second side wall panel. A first tuck flap extend from one end of the glue tab and minor bottom flaps are foldably joined to bottom edges of the respective end wall panels and major bottom flaps are foldably joined to bottom edges of the respective side wall panels. A first major top flap is foldably joined to the first side wall panel along an edge opposite the edge to which the major bottom flap is attached.

One end of the first major top flap is separated from its associated side wall panel by a cut and a second major top flap is foldably joined to the second side wall panel along an edge opposite the edge to which the major bottom flap is attached. A minor top flap is foldably joined to an edge of the first end wall panel opposite the edge to which a said minor bottom flap is attached. A second tuck flap foldably is joined to the second side wall panel adjacent the second major top flap and roll-over flaps are foldably joined to an edge of the second end wall panel opposite the edge to which the second minor bottom flap is attached. A slot is formed in the second end wall panel adjacent its folded connection with the roll-over flaps. A locking tab project from a free edge of the roll-over flaps and a first perforated line of weakness extends across the width of the second end wall panel spaced approximately ⅓ the length of the panel from the edge to which the first minor bottom flap is attached. A second perforated line extends diagonally across the first side wall panel from one end of the first perforated line to an inner end of the cut separating the one end of the first major top flap from its associated side wall. A third perforated line extends diagonally across the second side wall panel from the opposite end of the first perforated line to the juncture between the second major top flap and the second tuck flap.

One further aspect of the present invention is directed to a method of shipping and displaying packages of product which comprises providing a container having side walls and end walls and an open top and open bottom and foldable top flanges and bottom flanges for closing the open top and open bottom; folding the top flanges to close the open top; inverting the container so the open bottom is oriented upwardly; loading packages of product into the container through the open bottom so that the packages are oriented horizontally; folding the bottom flanges to close the open bottom; shipping the container to a point of sale with the container oriented so that the packages are oriented horizontally; at the point of sale orienting the container so that the packages are oriented in an upright position; and removing the removable cover base of the carton along perforated lines of weakness to form a display opening exposing said upright packages and making them accessible at a forward portion of the carton.

While particular embodiments of the invention have been illustrated and described in detail herein, it should be understood that various changes and modifications may be made in the invention without departing from the spirit and intent of the invention as defined by the appended claims.

What is claimed is:

1. A shipping carton convertible into a display configuration at a point of sale, comprising:

a display base; and a removable cover base configured to be attached to the display base to form the shipping carton convertible into a display configuration wherein:

the shipping carton convertible into a display configuration comprises opposite side walls each having a length and a top edge and a bottom edge, opposite end walls each having a width and a top edge and a bottom edge, top flaps foldably joined to the top edges of the side walls and end walls, and bottom flaps foldably joined to the bottom edges of the side walls and end walls, a first perforated line of weakness extending across the width of one of the end walls from one side wall to the opposed side wall, second and third perforated lines of weakness extending from respective opposite ends of the first perforated line and diagonally across respective corners of the side walls to an adjacent top edge of the respective side walls, and with the first perforated line of weakness defining the removable cover base of the carton that when removed forms a display opening devoid of walls extending across a portion of a forward end of the carton above the lines of weakness in the one end wall and the corners of the side walls and wherein the top flaps include:

tuck flaps extending inwardly toward one another from the top edges of the opposite side walls at one end thereof, the tuck flaps having a width less than the length of an associated said side wall, roll-over flaps extending from the top edge of one of the end walls, one of the roll-over flaps includes a locking tab at one edge thereof, the roll-over flaps being folded over the tuck flaps to hold the tuck flaps and side walls in folded position and form an edge spaced from the one end wall, and inner and outer major top flaps folded inwardly from the top edges of the opposite side walls into overlapping relationship with one another, the outer of the major top flaps having a free end extending into overlying relationship with the roll-over flaps, the free end being free of attachment to the roll-over flaps.

2. The shipping carton convertible into a display configuration of claim 1 wherein the overlapping major top flaps comprise a part of the removable cover base.

3. The shipping carton convertible into a display configuration of claim 1 wherein the inner of the overlapping major top flaps has a width to extend across the full width of the carton from one of the side wall to the opposite side wall, and a length to extend from one the end wall only to the edge of the roll-over flaps.

4. The shipping carton convertible into a display configuration of claim 1 wherein the outer of the overlapping major top flaps has a length and a width to extend from one of the side wall to the opposite said side wall and from one of the end wall to the opposite end wall.

5. The shipping carton convertible into a display configuration of claim 4 wherein a cut separates the free end of the outer major top flap from the adjoining side wall, the cut having a length substantially commensurate with the width of the tuck flaps.

6. The shipping carton convertible into a display configuration of claim 5 wherein the second and third perforated lines of weakness terminate at the top edges of the respective side walls at locations adjacent the edge of the roll-over flaps.

7. The shipping carton convertible into a display configuration of claim 5 wherein finger access openings for inserting a finger to initiate tearing of said perforated lines are formed in said one end wall and in said side walls contiguous to said perforated lines of weakness and midway their length.

8. The shipping carton convertible into a display configuration of claim 7 wherein one of the tuck flaps is foldably joined to the side wall and the other of the tuck flaps is foldably joined to an end of a glue tab attached to the opposite side wall, and a product retaining flange extends from one side edge of the one tuck flap, the product retaining flange is adapted to extend inwardly over a portion of one side of a display opening when the removable cover base is removed and the carton is in display configuration.

9. A shipping carton convertible into a display configuration at a point of sale, comprising:

a display base; and a removable cover base configured to be attached to the display base to form the shipping carton convertible into a display configuration wherein:

the shipping carton convertible into a display configuration comprises opposite side walls each having a length and a top edge and a bottom edge, opposite end walls each having a width and a top edge and a bottom edge, top flaps foldably joined to the top edges of the side walls and end walls, and bottom flaps foldably joined to the bottom edges of the side walls and end walls, a first perforated line of weakness extending across the width of one of the end walls from one side wall to the opposed side wall, second and third perforated lines of weakness extending from respective opposite ends of the first perforated line and diagonally across respective corners of the side walls to an adjacent top edge of the respective side walls, and with the first perforated line of weakness defining the removable cover base of the carton that when removed forms a display opening devoid of walls extending across a portion of a forward end of the carton above the lines of weakness in the one end wall and the corners of the side walls, and wherein the top flaps include:

tuck flaps extending inwardly toward one another from the top edges of the opposite side walls at one end thereof, the tuck flaps having a width less than the length of an associated said side wall, roll-over flaps extending from the top edge of one of the end walls, the roll-over flaps being folded over the tuck flaps to hold the tuck flaps and side walls in folded position and form an edge spaced from the one end wall, inner and outer major top flaps folded inwardly from the top edges of the opposite side walls into overlapping relationship with one another, the outer of the major top flaps having a free end extending into overlying relationship with the roll-over flaps, the free end being free of attachment to the roll-over flaps.

10. A blank for making a shipping carton convertible into a display configuration at a point of sale, the blank comprising:

a first side wall panel at a first end of the blank;

a first end wall panel adjoining the first side wall panel;

a second side wall panel adjoining the first end wall panel along an edge opposite that edge joined to the first side wall panel;

a second end wall panel adjoining the second side wall panel along an edge opposite the first end wall panel;

a glue tab foldably joined to an edge of the second end wall panel opposite the edge joined to the second side wall panel;

a first tuck flap extending from one end of the glue tab;

minor bottom flaps foldably joined to bottom edges of the respective end wall panels;

major bottom flaps foldably joined to bottom edges of the respective side wall panels;

a first major top flap foldably joined to the first side wall panel along an edge opposite the edge to which the major bottom flap is attached, one end of the first major top flap being separated from its associated side wall panel by a cut;

a second major top flap foldably joined to the second side wall panel along an edge opposite the edge to which the major bottom flap is attached;

a minor top flap foldably joined to an edge of the first end wall panel opposite the edge to which a said minor bottom flap is attached;

a second tuck flap foldably joined to the second side wall panel adjacent the second major top flap;

roll-over flaps foldably joined to an edge of the second end wall panel opposite the edge to which the second minor bottom flap is attached;

a slot formed in the second end wall panel adjacent its folded connection with the roll-over flaps;

a locking tab projecting from a free edge of the roll-over flaps;

a first perforated line of weakness extending across the width of the second end wall panel spaced approximately ⅓ the length of the panel from the edge to which the first minor bottom flap is attached;

a second perforated line extending diagonally across the first side wall panel from one end of the first perforated line to an inner end of the cut separating the one end of the first major top flap from its associated side wall; and a third perforated line extending diagonally across the second side wall panel from the opposite end of the first perforated line to the juncture between the second major top flap and the second tuck flap.

11. The blank of claim 10 wherein semi-circular cut-outs are formed contiguous to the respective lines of perforations and midway their length, defining finger access openings to enable a user's finger to be inserted for pulling out on the panels to break the perforated lines of weakness.

* * * * *